US007699711B2

(12) United States Patent
Tseng

(10) Patent No.: US 7,699,711 B2
(45) Date of Patent: Apr. 20, 2010

(54) SWING ASSEMBLY

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 146 days.

(21) Appl. No.: 11/833,370

(22) Filed: Aug. 3, 2007

(65) Prior Publication Data

US 2009/0036225 A1 Feb. 5, 2009

(51) Int. Cl.
*A63G 9/00* (2006.01)
*A63G 9/12* (2006.01)

(52) U.S. Cl. ..... 472/125; 297/273

(58) Field of Classification Search ..... 472/118, 472/120–125; 297/273, 274, 281, 284, 184.1
See application file for complete search history.

(56) References Cited

U.S. PATENT DOCUMENTS

| | | | | |
|---|---|---|---|---|
| 281,216 | A * | 7/1883 | White | 297/245 |
| 1,677,844 | A * | 7/1928 | Patton | 248/163.2 |
| 1,906,768 | A * | 5/1933 | Romine | 472/118 |
| 5,016,873 | A * | 5/1991 | Bossa | 472/118 |
| 6,402,233 | B1 * | 6/2002 | Tseng | 297/184.1 |
| 6,582,018 | B2 * | 6/2003 | Tseng | 297/281 |

* cited by examiner

*Primary Examiner*—Kien T Nguyen
(74) *Attorney, Agent, or Firm*—Ladas & Parry LLP

(57) ABSTRACT

A swing assembly includes a swing frame and at least two single-seater seat units. The swing frame includes a horizontal support bar and a plurality of spaced apart hook members disposed swingably on the support bar. Each single-seater seat unit includes a chair member, and a hanging unit connected to an adjacent pair of the hook members and further connected to the chair member. The single-seater seat units are swingable independently of each other on the swing frame.

2 Claims, 5 Drawing Sheets

SWING ASSEMBLY

BACKGROUND OF THE INVENTION

1. Field of the Invention

The invention relates to a swing assembly, and more particularly to a swing assembly capable of seating more than one person thereon.

2. Description of the Related Art

As illustrated in FIG. 1, a conventional swing assembly 1 includes a swing frame 11 and a swing chair 12 supported by the swing frame 11. Hitherto, the swing chair 12 is designed as an elongated chair for seating more than one person thereon. Because the swing assembly 1 has only one swing chair 12, all persons seated on the swing chair 12 would experience swinging simultaneously. That is to say, it is not possible for one person on the swing chair 12 to experience swinging while another person on the same swing chair 12 does not experience swinging, which can be a cause of inconvenience for some.

SUMMARY OF THE INVENTION

Therefore, it is an object of the present invention to provide a swing assembly that permits persons seated thereon to swing independently of each other.

According to the present invention, there is provided a swing assembly comprising a swing frame and at least two single-seater seat units. The swing frame includes a horizontal support bar and a plurality of spaced apart hook members disposed swingably on the support bar. Each of the single-seater seat units includes a chair member, and a hanging unit connected to an adjacent pair of the hook members and further connected to the chair member. The single-seater seat units are swingable independently of each other on the swing frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
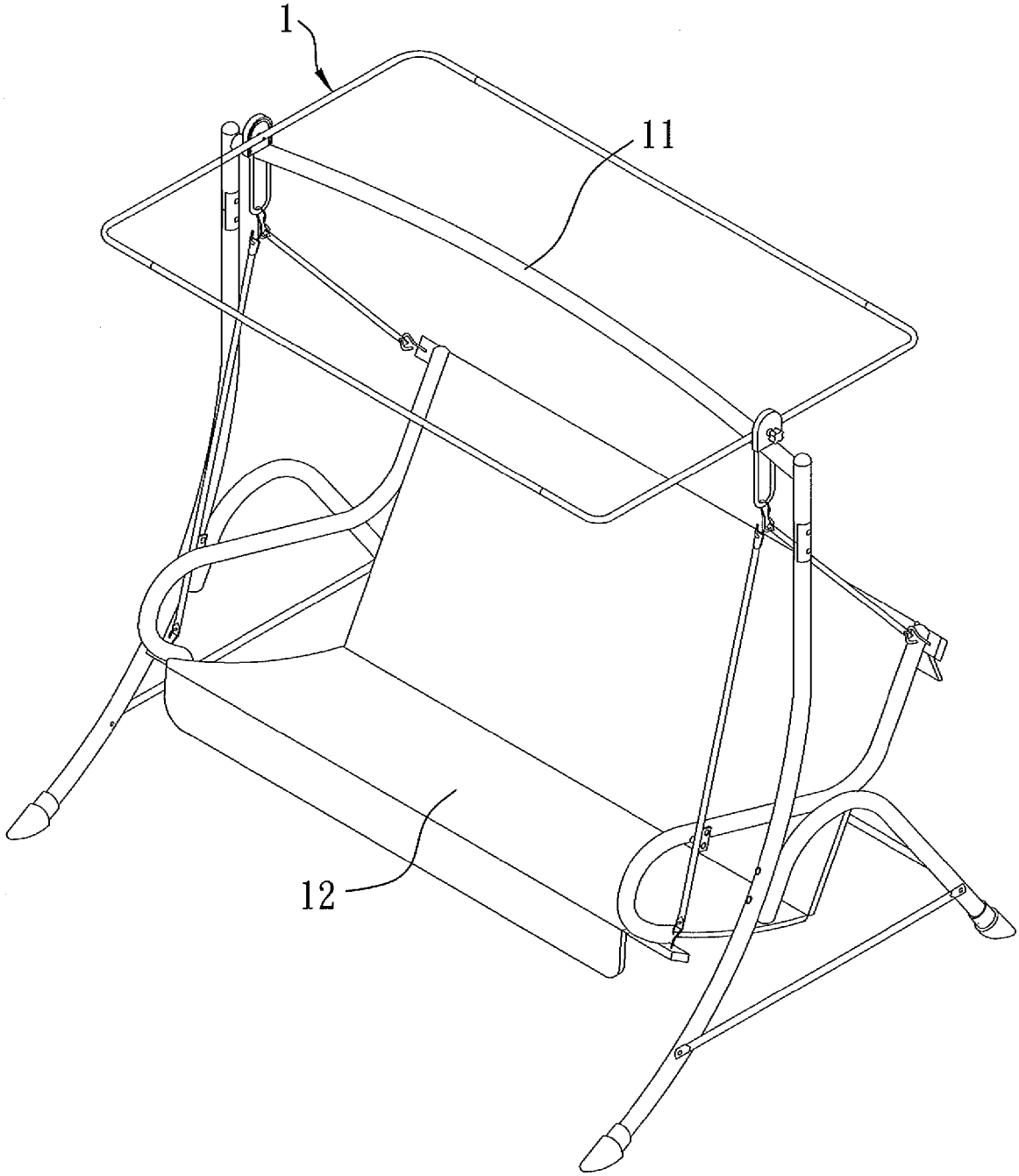
FIG. 1 PRIOR ART
FIG. 1 is a perspective view of a conventional swing assembly.
Figure 2:
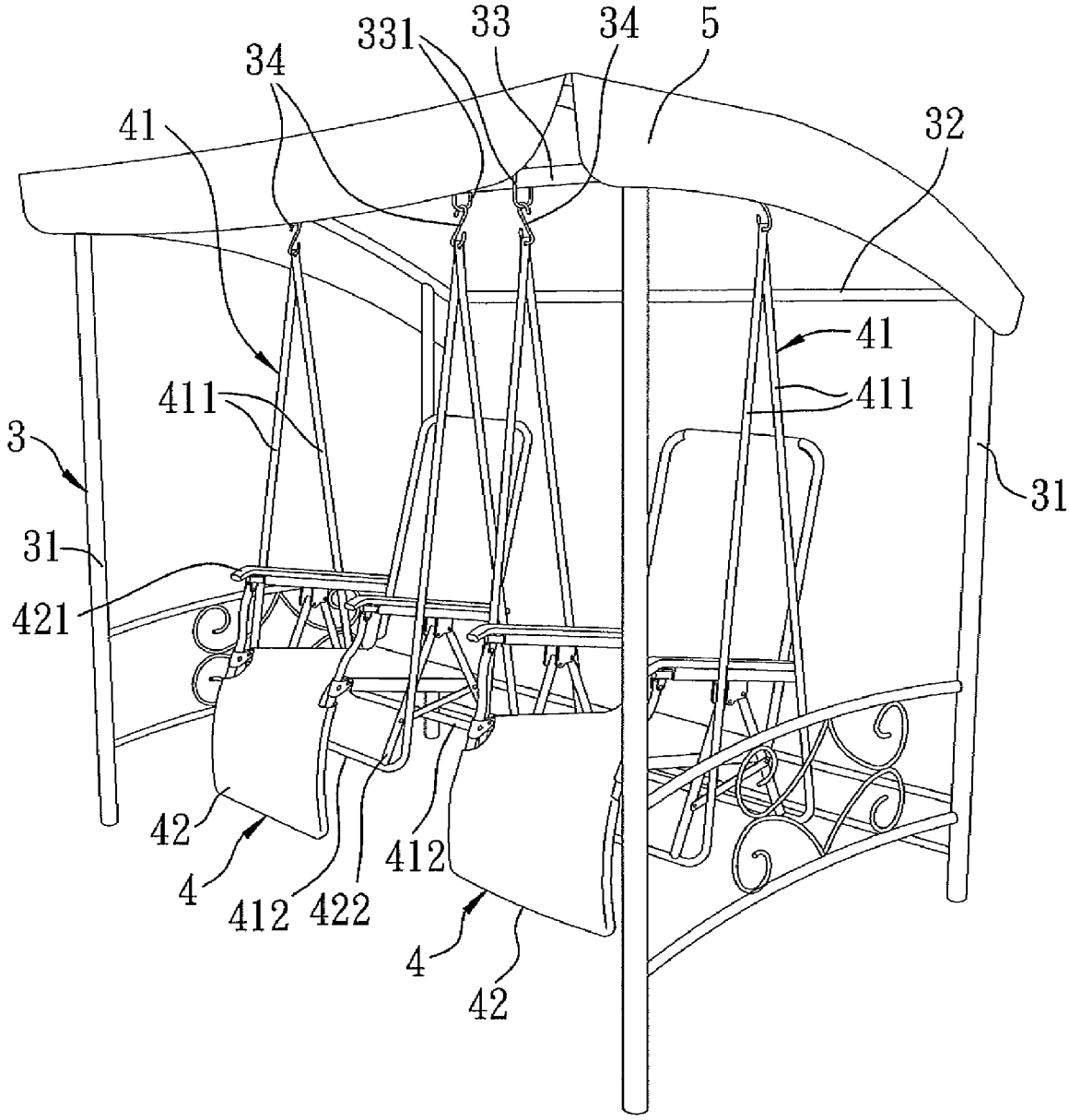
FIG. 2 is a perspective view of a preferred embodiment of a swing assembly according to the present invention.
Figure 3:
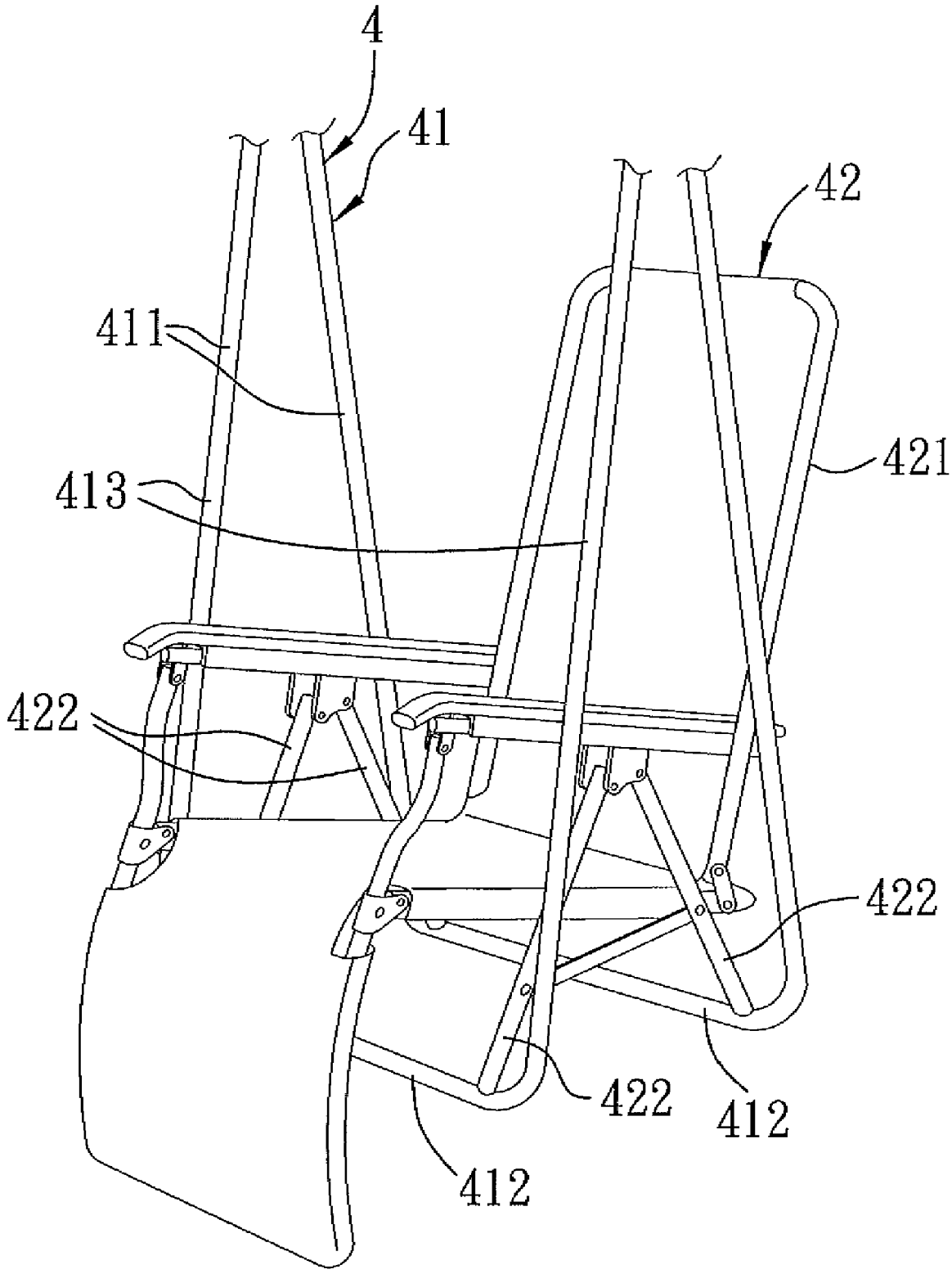
FIG. 3 is a fragmentary perspective view of a single-seater seat unit of the preferred embodiment.
Figure 4:
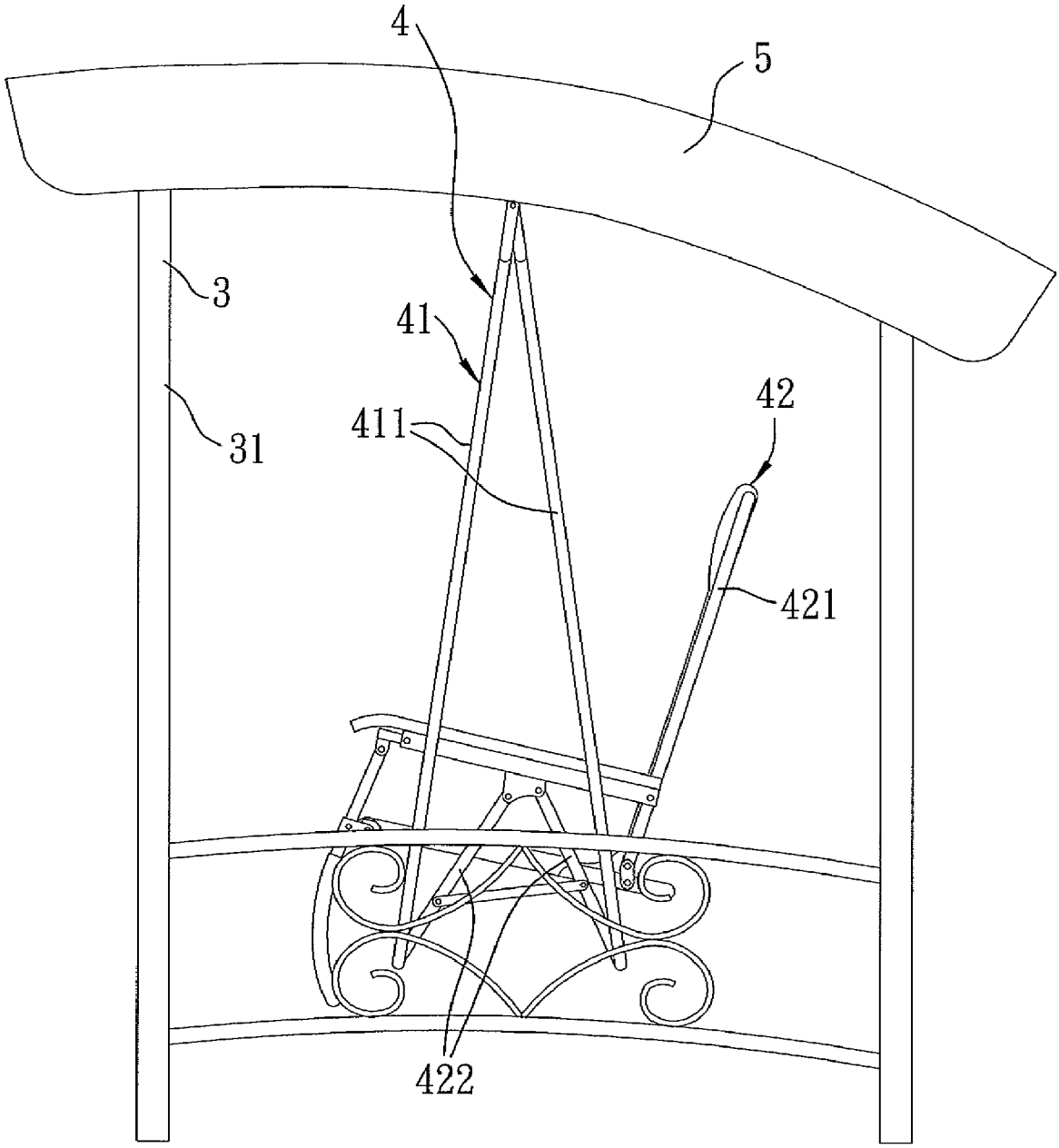
FIG. 4 is a side view of the preferred embodiment.
Figure 5:
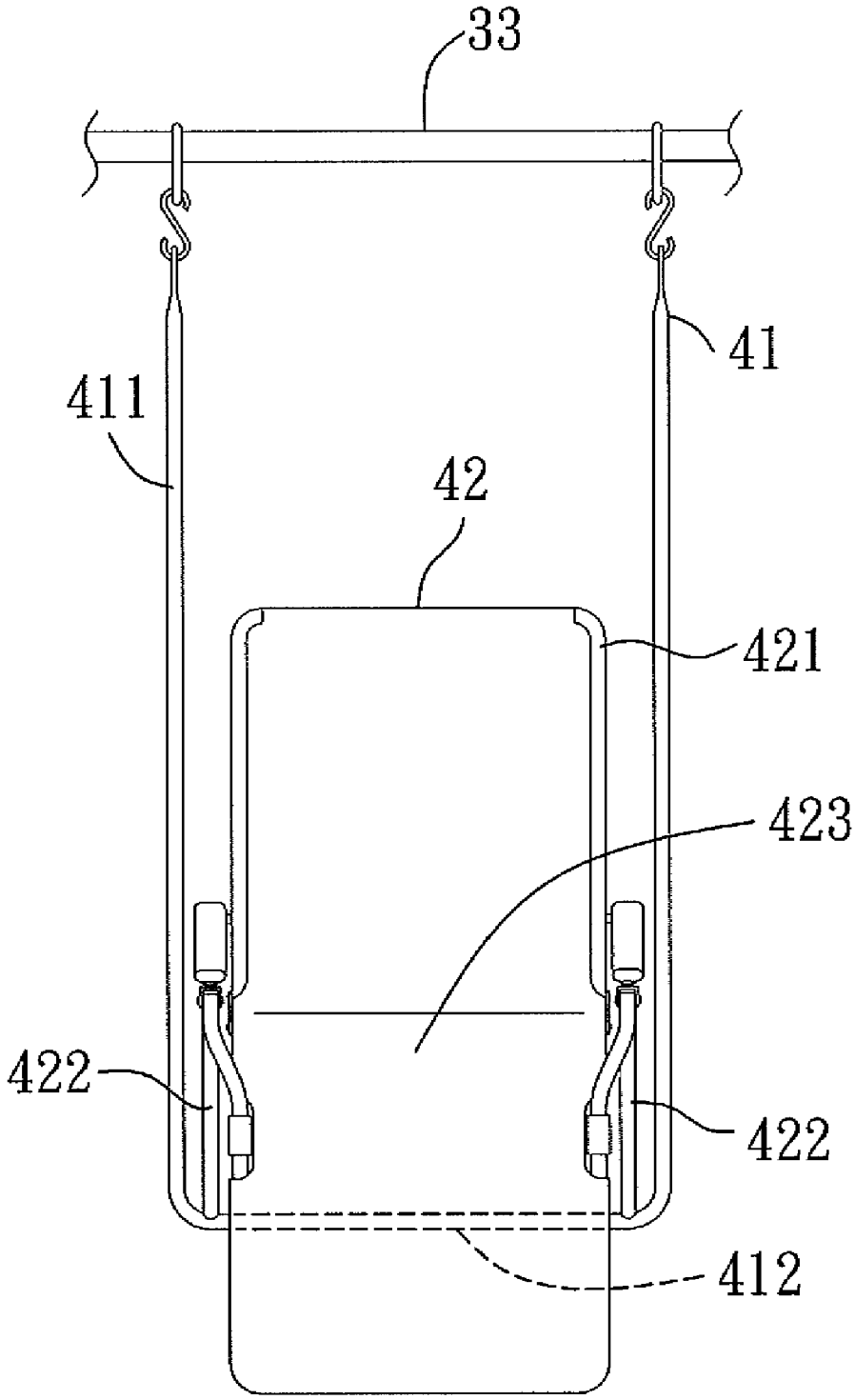
FIG. 5 is fragmentary front view showing the single-seater seat unit of the preferred embodiment.

As illustrated in FIGS. 2 to 5, the preferred embodiment of a swing assembly according to the present invention comprises a swing frame 3, two single-seater seat units 4 disposed swingably on the swing frame 3 and spaced apart from each other, and a canopy 5 mounted on the swing frame 3.

The swing frame 3 forms a standing structure that includes a frame leg unit, a horizontal support bar 33 and four hook members 34. The frame leg unit includes four legs 31 and two pairs of top rods 32 that interconnect top ends of the legs 31. The support bar 33 has opposite ends connected fixedly to an opposing pair of the top rods 32. The hook members 34 are disposed swingably on the support bar 33 and are spaced apart from each other. In this embodiment, each hook member 34 is an S-shaped hook which is hooked releasably on a corresponding ring 331 that is sleeved on the support bar 33 so as to be swingable in a front-to-rear direction. It should be noted that the shape of the hook member 34 is not limited to that which is disclosed herein.

Each of the single-seater seat units 4 includes a chair member 42 and a hanging unit 41 connected to an adjacent pair of the hook members 34 and further connected to the chair member 42 such that the latter is suspended on the support bar 33. The hanging unit 41 includes first and second U-shaped hangers 411 each having a horizontal part 412 connected fixedly to the chair member 42 and a pair of inclined parts 413 that extend respectively from opposite ends of the horizontal part 412 and that are disposed respectively on opposite lateral sides of the chair member 42. The inclined parts 413 of the first and second U-shaped hangers 411 disposed on the same lateral side of the chair member 42 have distal ends that are distal from the horizontal parts 412 of the first and second U-shaped hangers 411, that are interconnected fixedly to each other, and that are further connected to a respective one of the hook members 34. The chair member 42 includes a chair frame 421 having two pairs of connecting rods 422. Each of the pairs of the connecting rods 422 is connected at one end to the horizontal part 412 of a respective one of the U-shaped hangers 411. The chair member 42 further includes a support 423 in the form of a fabric or cushion mounted on the chair frame 421 for supporting a person seated on the chair member 42.

It should be noted that the shape of the hangers 411 of the hanging unit 41 is not limited to U-shaped in other embodiments of this invention. In addition, the connection between the hangers 411 and the chair member 42 should not be limited to that which is disclosed herein.

Furthermore, the number of the single-seater seat units 4 can be greater than two in other embodiments of this invention. In this case, the number of the hook members 34 must be increased accordingly.

The top rods 32 of the frame leg unit define an open side above the single-seater seat units 4. The canopy 5 is mounted on the open side of the leg frame unit to shield the single-seater seat units 4 from rain and sunshine.

In this invention, the single-seater seat units 4 are swingable independently of each other on the swing frame 3. In particular, when two persons are seated respectively in the single-seater seat units 4, each of them can drive the respective single-seater seat unit 4 to swing without causing the other single-seater seat unit 4 to swing. In addition, the connection between the chair frame 421 and the first and second U-shaped hangers 411 ensures that the weight of the person seated on the chair member 42 can be transmitted uniformly to the horizontal parts 412 of the first and second U-shaped hangers 411 to avoid sideward movement of the single-seater seat unit 4 during swinging, thereby preventing undesired collision between the single-seater seat units 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A swing assembly comprising:

a swing frame including a horizontal support bar and a plurality of spaced apart hook members disposed swingably on said support bar; and at least two single-seater seat units, each of which includes a chair member, and a hanging unit connected to an adjacent pair of said hook members and further connected to said chair member;

wherein said single-seater seat units are swingable independently of each other on said swing frame;

wherein said hanging unit includes first and second U-shaped hangers each having a horizontal part connected fixedly to said chair member and a pair of inclined parts that extend respectively from opposite ends of said horizontal part and that are disposed respectively on opposite lateral sides of said chair member, said inclined parts of said first and second U-shaped hangers disposed on the same lateral side of said chair member having distal ends that are distal from said horizontal parts of said first and second U-shaped hangers, that are interconnected fixedly to each other, and that are further connected to a respective one of said hook members; and wherein said chair member includes a chair frame having two pairs of connecting rods, each of said pairs of said connecting rods being connected at one end to said horizontal part of a respective one of said first and second U-shaped hangers.

2. The swing assembly as claimed in claim 1, wherein said swing frame further includes a frame leg unit, said support bar having opposite ends connected to said frame leg unit, said frame leg unit having an open side above said single-seater seat units, said swing assembly further comprising a canopy mounted on said open side of said frame leg unit to shield said single-seater seat units.

* * * * *